US012398527B2

(12) United States Patent
Lau et al.

(10) Patent No.: US 12,398,527 B2
(45) Date of Patent: Aug. 26, 2025

(54) CABLE-DRIVEN ROBOT SYSTEM FOR OPERATION INSIDE LONG PILES OR SHAFTS

(71) Applicant: The Chinese University of Hong Kong, Hong Kong (CN)

(72) Inventors: Darwin Tat Ming Lau, Hong Kong (CN); Hing Cheung Chan, Hong Kong (CN); Chun Keung Kwok, Hong Kong (CN); Ching Hei Cheng, Hong Kong (CN); Chung Lai Yeung, Hong Kong (CN); Ho Yin Chow, Hong Kong (CN); Sai Kwan Siu, Hong Kong (CN)

(73) Assignee: The Chinese University of Hong Kong, Hong Kong (CN)

( * ) Notice: Subject to any disclaimer, the term of this patent is extended or adjusted under 35 U.S.C. 154(b) by 466 days.

(21) Appl. No.: 17/804,990

(22) Filed: Jun. 1, 2022

(65) Prior Publication Data

US 2023/0392340 A1 Dec. 7, 2023

(51) Int. Cl.
*E02D 13/00* (2006.01)

(52) U.S. Cl.
CPC ..... *E02D 13/00* (2013.01); *E02D 2600/10* (2013.01)

(58) Field of Classification Search
CPC ..... E02D 13/04; E02D 13/06; E02D 13/08; E02D 23/06; E02D 23/16; E02D 15/00; E02D 15/02; E02D 15/04; E02D 15/06; E02D 15/10
See application file for complete search history.

(56) References Cited

U.S. PATENT DOCUMENTS

| | | | | |
|---|---|---|---|---|
| 6,566,834 | B1 | 5/2003 | Albus et al. | |
| 7,685,902 | B2 | 3/2010 | Kock et al. | |
| 2013/0236273 | A1* | 9/2013 | Heiler | B63C 11/42 414/141.8 |
| 2014/0064857 | A1* | 3/2014 | Herrmann | E02D 7/28 175/325.1 |

FOREIGN PATENT DOCUMENTS

| | | | | |
|---|---|---|---|---|
| CA | 2 654 461 | C | 3/2012 | |
| CN | 105035200 | B | 4/2017 | |
| CN | 107226145 | B | 10/2019 | |
| GB | 1506388 | * | 5/1975 | |
| GB | 1506388 | A * | 4/1978 | E02D 7/24 |
| WO | WO-2016144178 | A1 * | 9/2016 | B63B 27/22 |

* cited by examiner

*Primary Examiner* — Kyle Armstrong
(74) *Attorney, Agent, or Firm* — SALIWANCHIK, LLOYD & EISENSCHENK

(57) ABSTRACT

The subject invention pertains to systems and methods for controlling an end-effector moving in three-dimensional space within long piles or shafts. Systems can include a fixed base platform, a cable-driven working platform, a cable-driven end-effector, a sensing system including draw wire sensors, gyroscopes, sonar sensors, and lidar, a control system in communication with the sensing system, and actuators for cables. The end-effector can be configurable to become a cable-driven parallel end-effector, a serially linked arm, a flexible end-effector or an air-lifting end-tool in cases of cleaning founding layers in bored pile shafts. The control system can be configurable to regulate the lengths of cables through actuators and modulate the positions and orientations of the working platform and the end-effector.

20 Claims, 13 Drawing Sheets

CABLE-DRIVEN ROBOT SYSTEM FOR OPERATION INSIDE LONG PILES OR SHAFTS

BACKGROUND OF THE INVENTION

Most operations in long piles or shafts involving moving working platforms are usually one-dimensional motions along the pathways of the piles or shafts. While end-tools are often installed on the working platforms to perform different tasks, the respective actuators of the end-tools are usually coupled with the working platform. However, in some applications, actuators of the end-tools are not suitable to be placed at the working platform. For example, the weight of certain actuators can exceed the loading capacity of the working platform, the working environment can be underwater or flammable which limits the types of suitable actuators. Moreover, the costs and difficulties for maintenance of actuators are higher when the actuators are located at the working platform compared to actuators located at an easily-reachable area. As a result, systems and methods for distantly actuated working platforms and end-tools that are capable of performing three-dimensional motions are needed.

BRIEF SUMMARY OF THE INVENTION

Embodiments of the present invention can provide to a system that can be configured to perform operations inside long piles or shafts using a cable-driven robot. More specifically, the certain embodiments can provide a system and apparatuses that are capable of positioning one or more end-effectors in three-dimensional space for operation inside long piles or shafts, with the end-effector configured for one or more of a wide range of operations including inspection or operations inside a deep shaft and cleaning or inspecting the founding layer in the case of a bored pile shaft.

Embodiments can provide a cable-driven dual stage robotic system and methods for distantly actuated working platform and end-effector useful to perform operations along long piles or shafts while advantageously maintaining the actuators for both working platform and end-effectors easily accessible and protected from environmental factors within the shaft or pile.

In comparison to related art systems or methods, the subject invention is beneficial in working environments that are hazardous or where lifting capacity of the working platform is limited. Additionally, the maintenance and operation of the actuators are improved as some or all of the actuators are able to be easily accessed and protected from harsh environmental factors.

In current practice, a large diameter bored piling technique is commonly applied when constructing buildings as for transferring loads to the underground bedrock layer. Aggregates or boulders located at the bottom of the bored pile can affect the load bearing capacity of the pile base. Thus, cleaning of the pile base's aggregates is desired for developing higher bored pile quality. Related art methods of using a Reverse Circulation Drill (RCD) to perform cleaning by air-lifting is not only expensive and inefficient, but the cleaning quality is also not guaranteed. Embodiments can help to improve the cleaning quality by covering more area than the RCD and reducing the cost of bored piles since the improved quality of bored piles reduces the need of creating additional foundation piles induced by potential bored piles failure.

BRIEF DESCRIPTION OF THE DRAWINGS

FIGS. 1A-1D illustrate that in certain embodiments, the placement of the base platform with respect to the end-effector can be flexible with the use of a pulley system.

FIG. 5A and FIG. 5B each, respectively, illustrate a different actuating and cable routing system and method for flexible end-effectors.

DETAILED DISCLOSURE OF THE INVENTION

Figure 1A:
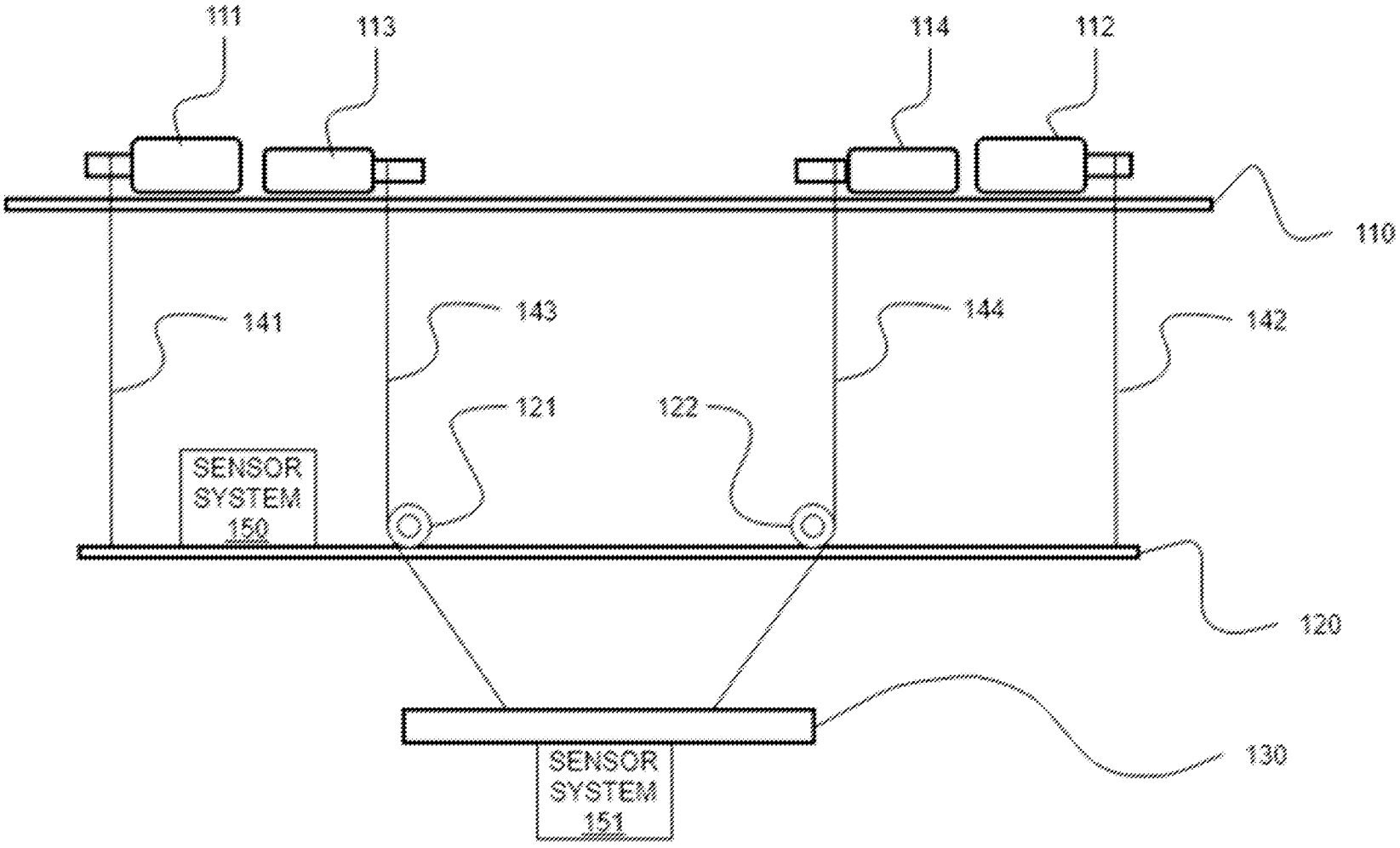
FIGS. 1A-1D show a system according to an embodiment of the subject invention with a fixed base platform, moving working platform, and end-effector; each of which, respectively, are driven by cables.

In one embodiment, a cable-driven robot system for operation in long shafts or piles comprises a fixed base platform, a working platform, a cable-driven end-effector, a sensing system for the working platform and end-effector, and a control system for the working platform and end-tools. The base platform can comprise the actuators for the movement of the working platform and the end effectors and can be at fixed location. The working platform can comprise the cable-driven elements for the end-tools and can be capable of moving along the direction of which the shaft or pile extends with the ability to tilt, rotate, translate, or extend in one, two, or more directions. The cable-driven end-effector is configurable for performing different tasks corresponding to various applications. The sensing system for the working platform and cable-driven end-effector can comprise one or more draw wire sensors, gyroscopes, sonar sensors and lidar for detecting the states (e.g., positions and orientations) of the working platform and the cable-driven end-effector. In certain embodiments, the control system can embody the method for controlling the positions of the working platform and the cable-driven end-effector in a fully or semi-automatic fashion by manipulating the length of a plurality of cables. During operations of the system, the working platform can be actuated along the shaft or pile by a set of cables with feedback from the sensor system to calculate the position and orientation of the working platform. Calibration of tilting of the working platform can be conducted automatically through the control system or by users based on the feedback in order to maintain the platform at a desired orientation (e.g., horizontal.) The user can also tilt the working platform at desired tilting angles with their specific applications. End-effectors can be driven by cables which can be directly connected to the actuation module on the base platform or routed through the working platform, and optionally connected to the actuation module on the base platform. The state of the end-tools, such as position and orientation, can be obtained by the sensor system to perform accurate motions and repeatable tasks. The working platform can be responsible for but not limited to the macro motions (e.g., gross depth, angle, or positioning) of the system and the end-tools can be responsible for but not limited to micro motions (e.g., precise depth, angle, orientation, or fine movement) of the system. The collaboration, coordination, or control of the macro motions and micro motions (e.g., together, separately, or in parallel) can allow the end-tools to conduct three-dimensional motion accurately throughout the working environment.

Several non-limiting embodiments of various end-tools are provided. One exemplary first embodiment includes an end-effector which is not coupled with a working platform with rigid link, or alternatively is free of any rigid connection or coupling to the working platform, or is connected solely, primarily, functionally, or effectively to the working platform only by cables, wires, or other flexible tension members. The end-effector can be driven by parallelly connected cables or other flexible tension members to be capable to possess up to six degree-of-freedom motion and control. A second exemplary embodiment can include a serially linked arm having one or more links. Each link of the arm can be driven by a set of cables attached to the arm to target position and orientation. A third non-limiting embodiment includes a flexible end-effector. The position and orientation can be controlled by the collaboration of a set of cables working against the stiffness of the flexible end-effector. Other embodiments can include parallel mechanisms, continuously flexible mechanisms, combined rigid and flexible structures, and other mechanisms controlled by cables, tension members, compression members, dynamic or hydrostatic fluid or pneumatic forces, or other forces such as magnetism, electromagnetism, phase change, steam, or other expanding gases or materials.

One specific non-limiting embodiment with a flexible end-effector is a cable-driven system which can include a fixed base platform, a moving working platform attached with hard pipe and/or flexible hose, a sensor system comprising or consisting of one or more sets of draw wire sensors, gyroscopes, sonar sensors, lidar, and control algorithms. In certain embodiments, the system can be capable of driving the end-effector to different positions inside the shaft which can be inaccessible for human workers. When using one or more flexible hoses as an end-effector, the system is capable of driving the hose to different positions inside the bored pile shaft, and enabling the delivery of resources, such as water, air, concrete and other building materials, through the hard pipe and/or soft hose by driving the hose to sweeping or swiping along different positions. The entire process can be controlled by the cable-driven system with sensor system and control algorithms to achieve more automated action and higher sensing and control resolution as compared to related art systems and methods.

Embodiments can provide a cable-driven dual stage robot system configured and adapted to perform operations in long shafts or piles. The system can consist of a base platform, a cable-driven working platform, a cable-driven end-effector, a sensing system for the working platform and end-effector and a control system for the working platform and end-effector tools.

Actuation units are capable to control the lengths of cables independently. Two sets of actuation units are included in the robotic system to control the states, including position and orientation, of the working platform and the end-effectors independently through cables. In general, the number of cables can be any number greater than one. The cables can be connected to the working platform with pulley system as a means to relocate the fixed based platform to a desirable position based on the environment and preference of the user. In certain embodiments the cables can be connected to the end-effector directly from the actuation units or routed through a pulley system located at the working platform, at the base platform, or at an intermediate location. The end-effector can be connected to the working platform through either cables or rigid links, or both cables and rigid links depending on the operation requirements.

The base platform can be fixed on an accessible position. In the example of bored pile base cleaning, the base platform can be located on the top of the bored pile casing. And the actuators on the base platform can drive the cables connected to the working platform and the end effector, respectively. By varying the length of the cables, position and orientation of the working platform relative to the base platform and those of the end-effector relative to the working platform can be manipulated.

The sensor system on the working platform can include draw wire sensors, gyroscope sensors, sonar sensors, and lidar to determine the state, including position and orientation, of the working platform. Additionally, sensor system on the end-effector can include draw wire sensors and gyroscope sensors to determine the state, including position and orientation, of the end-effector. The feedback from sensor systems enables accurate control of the working platform and the end-effector.

Operating procedures can include:

1. Set up the robotic system
2. Drive the working platform to working depth
3. Manipulate the end-effector to a desired operating pose (position and orientation)
4. Start end-point operations, e.g., air-lifting
5. Monitor the quality of the end-point operations
6. Manipulate the end-effector to another operating pose
7. Repeat steps 4 to 6 until the end-point operations are complete In certain embodiments the working depth of bored pile operations can be known beforehand by the user. The sensor system on the working platform enables the working platform to accurately reach the working depth with automation. The current state of the working platform is first obtained by the sensor system and correlates with current actuating cable lengths which can depend on the number and configuration of actuating cables. The change in actuating cable lengths can then be calculated based on target state of the working platform and current actuating cable lengths with the verifications of valid input state of the working platform and availability of cable lengths of actuating units.

As the cables to the end-effector can be routed through the working platform, the state, including position and orientation, of the end-effector can be highly related to the state of the working platform. During the motion of working platform, the cables of the end-effectors need to be tightened to maintain the state, pose, or gesture to perform tasks during lifting of the working platform and inhibit or reduce the potential for damage to the robotic system due to uncontrolled motion or undetermined position or orientation of the end-effector. The control can be completed by utilizing feedback from the sensor system.

During the motions of the end-effector, the cable tensions can change with different states of the end-effector where the maximum actuating cable tensions can be limited by the working load limit of the pulleys and weight of the working platform. The actuating cable tensions can be advantageously controlled to be below maximum to inhibit damage or unexpected tilting of the working platform during the movement process of the end-effector. The unexpected tilting of the working platform by the end-effector actuating cables can be related to the weight and weight distribution of the working platform, and number and arrangement of the end-effector actuating cables. If one or some of the actuating cable tensions exceed maximum actuating cable tensions, the corresponding state is regarded as undesired, and a new state can be advantageously determined. The desired actuating cable tensions can be computed corresponding to the state of the end-effector and the actuating cable lengths. In certain embodiments, the current feedback of the actuating units can be utilized to estimate the actual cable tensions.

The invention may be better understood by reference to certain illustrative examples and embodiments, including but not limited to the following:

Embodiment 1. A system for operating in long piles or shafts, the system comprising:

a fixed base platform, a movable working platform driven by a first plurality of cables, and a cable-driven end-effector coupled with the working platform and driven by a second plurality of cables.

Embodiment 2. The system of Embodiment 1, wherein each cable of the first plurality of cables is attached to a corresponding cable actuating unit of a first plurality of cable actuating units, and wherein each cable actuating unit of the first plurality of cable actuating units is configured to control the length of the correspondingly attached cable of the first plurality of cables; and wherein each cable of the second plurality of cables is attached to a corresponding cable actuating unit of a second plurality of cable actuating units, and wherein each cable actuating unit of the second plurality of cable actuating units is configured to control the length of the correspondingly attached cable of the second plurality of cables.

Embodiment 3. The system of Embodiment 1, wherein the first plurality of cables are separate and independent from the second plurality of cables; wherein a first plurality of cable actuating units is configured to control the position and orientation of the working platform through the first plurality of cables; and wherein a second and independent plurality of cable actuating units is configured to control the position and orientation of the end-effector through the second plurality of cables.

Embodiment 4. The system of Embodiment 3, wherein the first plurality of cable actuating units and the second plurality of cable actuating units are located at the base platform. Located at the base platform can include mounted on, or in a fixed position not directly connected to but stationary relative to the base platform (e.g., as shown in FIG. 1C).

Figure 1B:
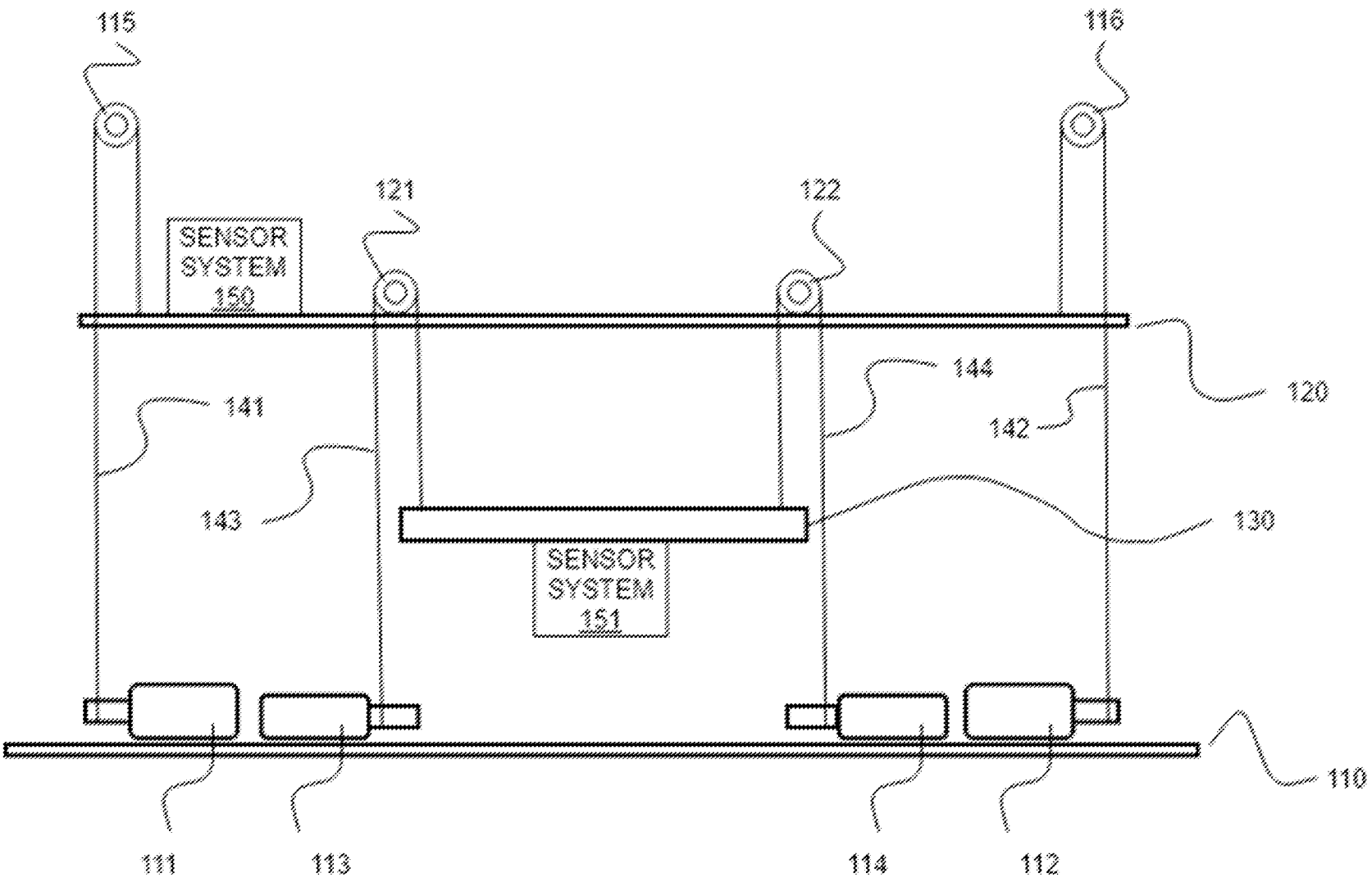
Figure 1C:
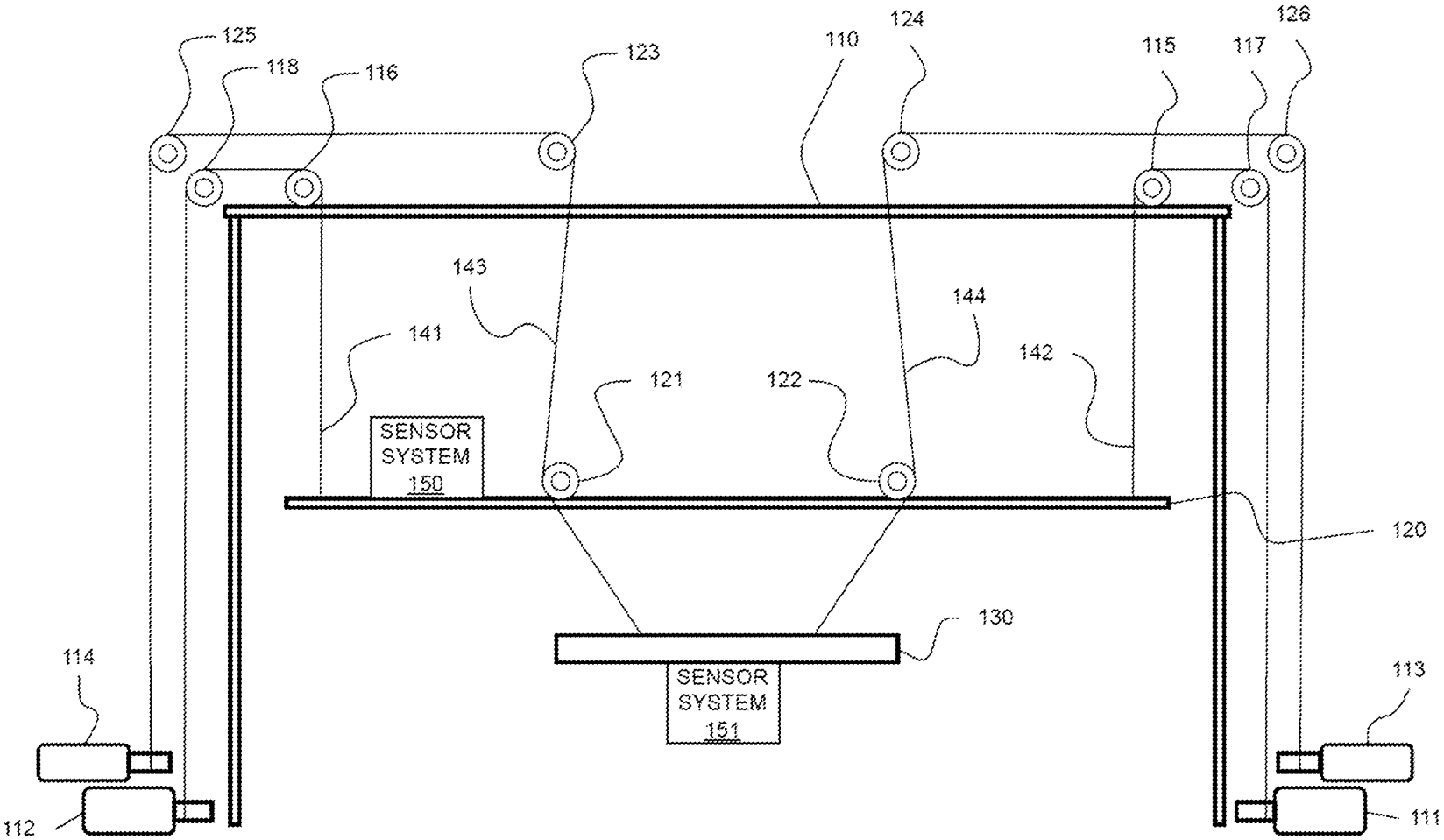
Figure 1D:
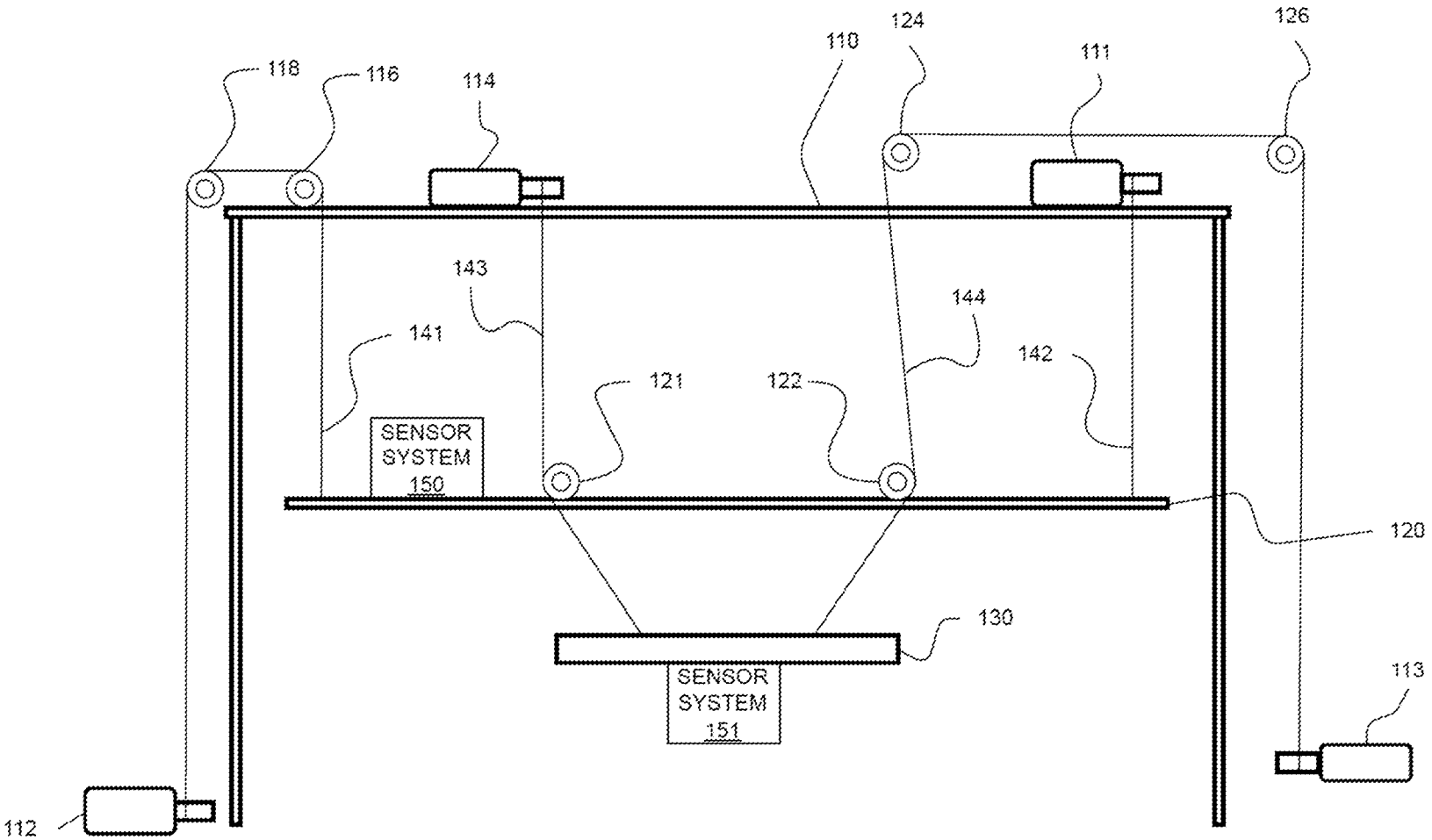

In a first non-limiting example, the first plurality of cable actuating units and the second plurality of cable actuating units are fixed on or within the base platform (e.g., as shown in FIG. 1A and FIG. 1B). In a second non-limiting example, the first plurality of cable actuating units and the second plurality of cable actuating units are mounted on a separate structure that is not the base platform but that is stationary or has a known position with respect to the base platform (e.g., as shown in FIG. 1C). In a third non-limiting example, some or all of the first plurality of cable actuating units are mounted in a first location and some or all of the second plurality of cable actuating units are mounted to a second location. Either the first location or the second location can be located on the base platform and the other location is not on the base platform (e.g., mounted on a casing or other structure separate from the base platform as shown in FIG. 1D). For example, certain embodiments can provide selected cable actuating units that are winches for driving a working platform mounted on a base platform, and other cable actuating unites that are winches for driving an end effector mounted on a casing or other grounded structure, but not directly attached to the base platform (e.g., mounted on in an accessible and stable location, such as the bottom of a casing). Alternative embodiments can provide selected cable actuating units that are winches for driving an end effector mounted on a base platform, and other cable actuating unites that are winches for driving a working platform mounted on a casing or other grounded structure, but not directly attached to the base platform (e.g., mounted on in an accessible and stable location, such as the bottom of a casing). According to the non-limiting illustrated embodiment in FIG. 1D, various combinations, sizes, and placement of cable actuating units and cable routing can be advantageously applied to meet the needs of specific applications.

Embodiment 5. The system of Embodiment 1, wherein the working platform comprises a first sensor system configured to determine the working condition, position, and orientation of the working platform. The working condition of the working platform can include tension, stress, length, effective length, extension, retraction, position, orientation, speed, velocity, or acceleration of the platform, of one or more cables, and any combinations thereof. The working condition can also include other measurable properties of the cable or platform useful in identifying, understanding, or controlling the platform, each cable, a plurality of cables, or a system comprising cables.

Embodiment 6. The system of Embodiment 5, wherein the first sensor system comprises one or more draw wire sensors, one or more gyroscopes, one or more sonar sensors, and at least one lidar sensor.

Embodiment 7. The system of Embodiment 1, wherein the end-effector comprises a second sensor system configured to determine the working condition, position, and orientation of the end-effector. The working condition of the end-effector can include tension, stress, length, effective length, extension, retraction, position, orientation, speed, velocity, or acceleration of the end-effector, of one or more cables, and any combinations thereof. The working condition can also include other measurable properties of the cable or end-effector useful in identifying, understanding, or controlling the end-effector, each cable, a plurality of cables, or a system comprising cables.

Embodiment 8. The system of Embodiment 7, wherein the second sensor system comprises one or more draw wire sensors, one or more gyroscopes, one or more sonar sensors, and at least one lidar sensor.

Embodiment 9. The system of Embodiment 1, wherein the base platform is configured for location at one of a plurality of different positions prior to operation of the system; wherein the first plurality of cables are connected to the working platform, optionally through a first pulley system; and wherein the second plurality of cables are connected to the end-effector through a second pulley system.

Embodiment 10. The system of Embodiment 1, wherein the end-effector is coupled with the working platform without rigid links, and wherein the end-effector is coupled with the working platform at least in part by the second plurality of cables.

Embodiment 11. The system of Embodiment 1, wherein the end-effector comprises a serially linked arm attached to the working platform.

Embodiment 12. The system of Embodiment 1, wherein the system is configured to operate inside a bored pile shaft.

Embodiment 13. The system of Embodiment 12, wherein the system comprises rigid pipe, and wherein the end-effector comprises a flexible hose configured for resource transportation or delivery.

Embodiment 14. The system of Embodiment 13, wherein the rigid pipe is tremie pipe, wherein the flexible hose is a flexible air-lift inlet hose.

Embodiment 15. The system of Embodiment 14, wherein the system comprises a tremie pipe stabilizing system.

Embodiment 16. The system of Embodiment 15, wherein the tremie pipe stabilizing system is configured to stabilize an end of the tremie pipe at or near the working platform and to stabilize an opposite end of the tremie pipe at or near the base platform when inserting a new section of tremie pipe.

Embodiment 17. The system of Embodiment 12, wherein the system comprises an anti-jam system attached to the working platform, wherein the anti-jam system comprises a plurality of guide rollers and a plurality of platform plates, each platform plate, respectively, having one or more chamfered sides.

Embodiment 18. A method for controlling an end-effector to reach a specified position and orientation in a three-dimensional space within a long pile or shaft, the method comprising:

providing a system comprising:

a fixed base platform, a movable working platform controlled by a first plurality of cables, a cable-driven end-effector supported by the working platform, the end-effector controlled by a second plurality of cables, and a control system comprising an end-effector sensor system configured to determine an actual position and orientation of the end-effector;

receiving feedback from the control system; and controlling the position and orientation of the end-effector by adjusting a working condition of the first plurality of cables and a working condition of the second plurality of cables based on the feedback to reach the specified position and orientation in the three-dimensional space within the long pile or shaft.

The working condition of the first plurality of cables or the working condition of the second plurality of cables, respectively, can include length, effective length, extension, retraction, tension, stress, slack, curvature, position, velocity, acceleration, or other measurable parameters of each individual cable taken individually or measured, considered, calculated, or aggregated across two or more cables at one or more points in time.

Embodiment 19. The method of Embodiment 18, wherein:

the first plurality of cables originates from the base platform;

the second plurality of cables originates from the base platform;

the control system further comprises a working-platform sensor system configured to determine an actual working condition, position, and orientation of the working platform; and the end-effector sensor system is further configured to determine an actual working condition, position, and orientation of the end-effector;

such that the feedback comprises the actual working condition, position, and orientation of the working platform and the actual working condition, position, and orientation of the end-effector.

Embodiment 20. A system for operating in long piles or shafts, the system comprising:

a fixed base platform, a movable working platform driven by a first plurality of cables, a cable-driven end-effector coupled with the working platform and driven by a second plurality of cables;

wherein a first plurality of cable actuating units is configured to control the position and orientation of the working platform through the first plurality of cables; and wherein a second and independent plurality of cable actuating units is configured to control the position and orientation of the end-effector through the second plurality of cables;

wherein the first plurality of cable actuating units and the second plurality of cable actuating units are located at the base platform;

wherein the working platform comprises a first sensor system configured to determine the position and orientation of the working platform;

wherein the first sensor system comprises one or more draw wire sensors, one or more gyroscopes, one or more sonar sensors, and at least one lidar sensor;

wherein the end-effector comprises a second sensor system configured to determine the position and orientation of the end-effector;

wherein the second sensor system comprises one or more draw wire sensors, one or more gyroscopes, one or more sonar sensors, and at least one lidar sensor;

wherein the base platform is configured for location at one of a plurality of different positions prior to operation of the system; wherein the first plurality of cables are connected to the working platform through a first pulley system; and wherein the second plurality of cables are connected to the end-effector through a second pulley system;

wherein the end-effector is coupled with the working platform without rigid links, and the end-effector is coupled with the working platform at least in part by the second plurality of cables;

wherein the end-effector comprises a serially linked arm attached to the working platform;

wherein the system is configured to operate inside a bored pile shaft;

wherein the system comprises rigid pipe, and wherein the end-effector comprises a flexible hose configured for resource transportation or delivery;

wherein the rigid pipe is tremie pipe, wherein the flexible hose is a flexible air-lift inlet hose;

wherein the system comprises a tremie pipe stabilizing system;

wherein the tremie pipe stabilizing system is configured to stabilize an end of the tremie pipe at or near the working platform and to stabilize an opposite end of the tremie pipe at or near the base platform when inserting a new section of tremie pipe;

wherein the system comprises an anti-jam system attached to the working platform, wherein the anti-jam system comprises a plurality of guide rollers and a plurality of platform plates, each platform plate, respectively, having one or more chamfered sides.

Embodiment 21. The method of Embodiment 18 or 19, wherein the end effector can reach any position and orientation within the 3D space beneath the platform-based system, the method comprising a system of any of Embodiment 1 to 17 and configuring and/or operating the system to control the end effector reaching any position within the 3D space beneath the platform-based system.

Embodiment 22. The method of Embodiment 18 or 19, wherein the working platform is configured and adapted to reach the full depth of the pile or shaft from a starting position at a specified initial depth below the base platform; wherein the end effector is configured and adapted reach any position within a three-dimensional working envelope defined beneath the working platform; the method comprising providing a system of any of Embodiment 1 to 17 and configuring and/or operating the system to control the end effector to reach a defined position and orientation within the working envelope.

Embodiment 23. The method of Embodiment 22, wherein the working envelope is defined by an extension of a 2D profile of the working platform along an axial direction or path of the long pile or shaft.

Embodiment 24. The method of Embodiment 23, wherein the end effector is configured and adapted reach any position within the working envelope with a specified orientation.

Embodiment 25. The method of Embodiment 24, wherein the working platform and the end effector are each respectively configured and adapted to allow the end-effector to reach any position and any orientation within an inner envelope that is smaller than the working envelope.

Embodiment 26. The method of Embodiment 25, wherein the working platform and the end effector are each respectively configured and adapted to allow the end-effector to reach any position and a specified subset of orientations within the working envelope.

Embodiment 27. The method of Embodiment 26, wherein the specified subset of orientations within the working envelope comprises orientations perpendicular or parallel to an outer surface of the working envelope.

Materials and Methods

The terminology used herein is for the purpose of describing particular embodiments only and is not intended to be limiting of the invention. As used herein, the term "and/or" includes any and all combinations of one or more of the associated listed items. As used herein, the singular forms "a", "am", and "the" are intended to include the plural forms as well as the singular forms, unless the context clearly indicates otherwise. It will be further understood that the terms "comprises" and/or "comprising", when used in this specification, specify the presence of stated feature, steps, operations, elements, and/or components, but do not prelude the presence or addition of one or more other features, steps, operations, elements, components, and/or group thereof.

Unless otherwise defined, all terms (including technical and scientific terms) used herein have the same meaning as commonly understood by one having ordinary skill in the art to which this invention pertains. It will be further understood that terms, such as those defined in commonly used dictionaries, should be interpreted as having a meaning that is consistent with their meaning in the context of the relevant art and the present disclosure and will not be interpreted in an idealized or overly formal sense unless expressly so defined herein.

In describing the invention it will be understood that a number of techniques and steps are disclosed. Each of these has individual benefits and each can also be used in conjunction with one or more, or in some cases all, of the other disclosed techniques. Accordingly, for the sake of clarity, this description will refrain from repeating every possible combination of the individual steps in an unnecessary fashion. Nevertheless, the specification and claims should be read with the understanding that such combinations are entirely within the scope of the invention and the claims.

FIGS. 1A and 1B illustrate an embodiment including a system with a fixed base platform 110, cable-driven working platform 120 and cable-driven end-effector 130. A fixed base platform 110 can be a platform which does not move during the operations of the system, wherein the actuation units 111, 112 for the working platform and the actuation units 113 and 114 for the end-effector are located at the fixed base platform 110. While in FIGS. 1C and 1D illustrate embodiments with some or all of the actuation units 111, 112, 113 and 114 located at a fixed location not directly connected to the base platform but stationary relative to the base platform (e.g., mounted to a casing or other grounded structure either adjacent to the base platform or remote from the base platform). Actuation units 111, 112 are capable to control the lengths of cables 141, 142 independently, therein control the state, including position and orientation, of the working platform 120. In illustration of FIGS. 1A and 1B, two cables 141, 142 are presented in an embodiment to control the working platform 120. In general, the number of cables can be any number greater than one. In certain embodiments a single cable can be employed with or without other means of support to control the working platform 120 in one or more degrees of freedom. Also, the cables 141, 142 can be connected to the working platform 120 with pulley system 115, 116 as a means to relocate the fixed based platform 110 to a desirable position based on the environment and preference of the user.

Actuation units 113, 114 are capable to control the lengths of cables 143, 144 independently, therein control the state, including position and orientation, of the end-effectors 130. In illustration of FIGS. 1A and 1B, two cables 143, 144 are presented in an embodiment to control the end-effectors 130. In general, the number of cables can be any number greater than one. In certain specific embodiments the number of cables can be one. The cables 143, 144 can be connected to the end-effector 130 directly from the actuation units 113, 114 or routed through pulley system 121, 122 located at the working platform 120. The end-effector 130 can be connected to the working platform 120 through either cables 143, 144 or rigid links, or both cables 143, 144 and rigid links depending on the operation requirements.

Sensor system 150 on the working platform 120 can include draw wire sensors, gyroscope, sonar sensors and lidar to determine the state, including position and orientation, of the working platform 120. Moreover, sensor system 151 on the end-effector 130 can include draw wire sensors and one or more gyroscopes to determine the state, including position and orientation, of the end-effector 130. The feedback from sensor systems 150, 151 enables accurate control of the working platform 120 and the end-effector 130.

Figure 7A:
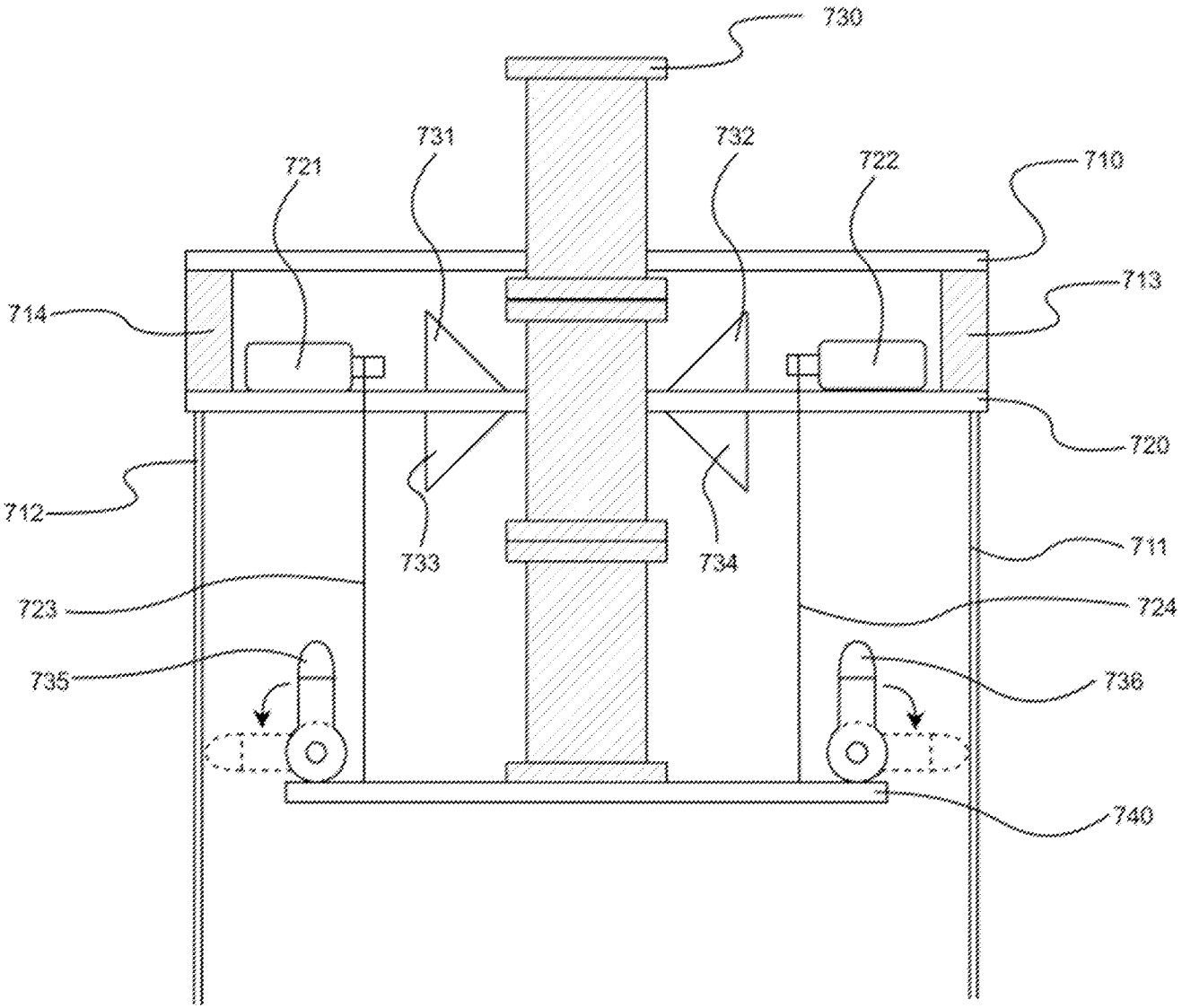
FIG. 7A and FIG. 7B each, respectively, shows an exemplary tremie pipe stabilizing system according to an embodiment of the subject invention.
Figure 7B:
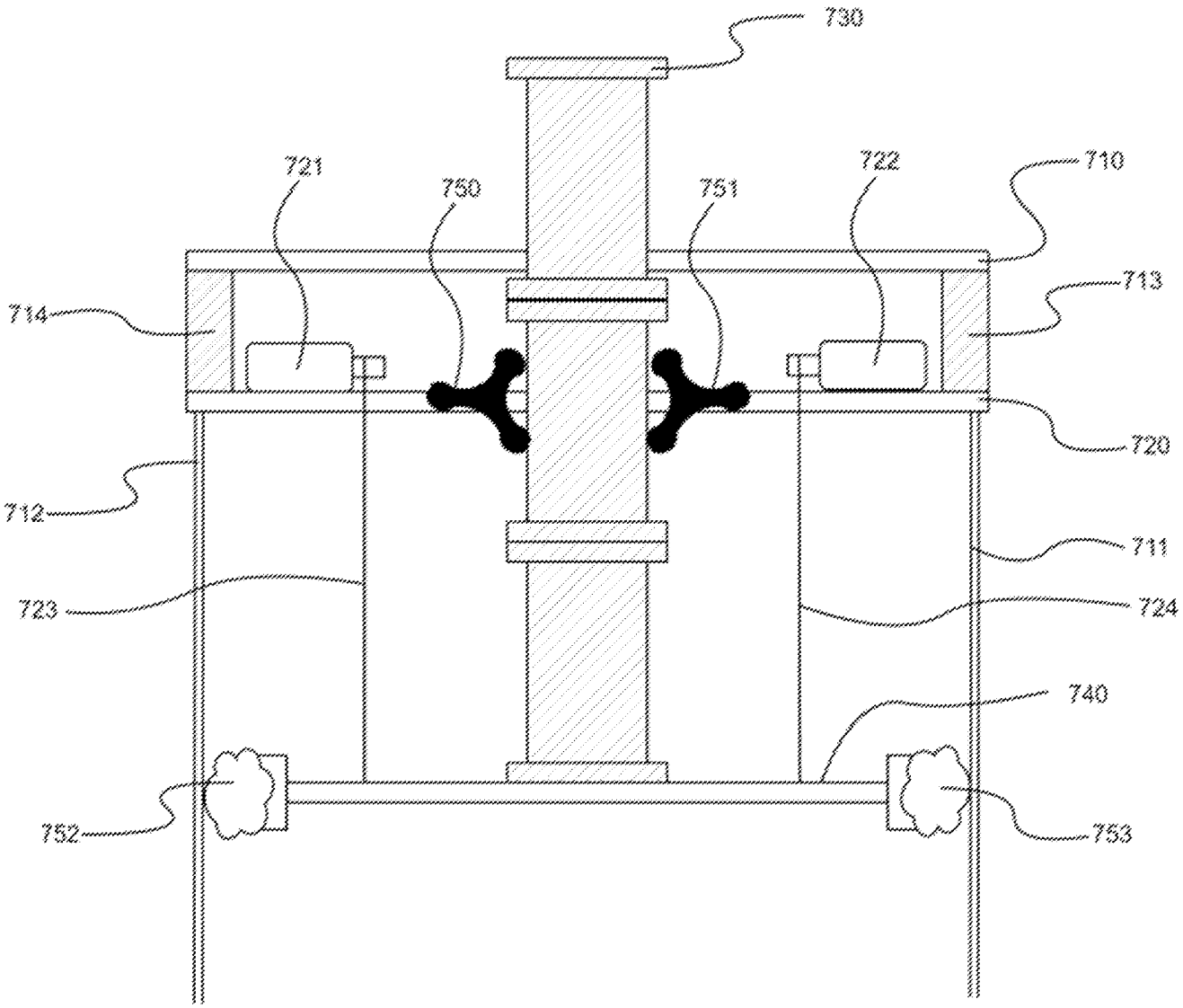
Figure 8:
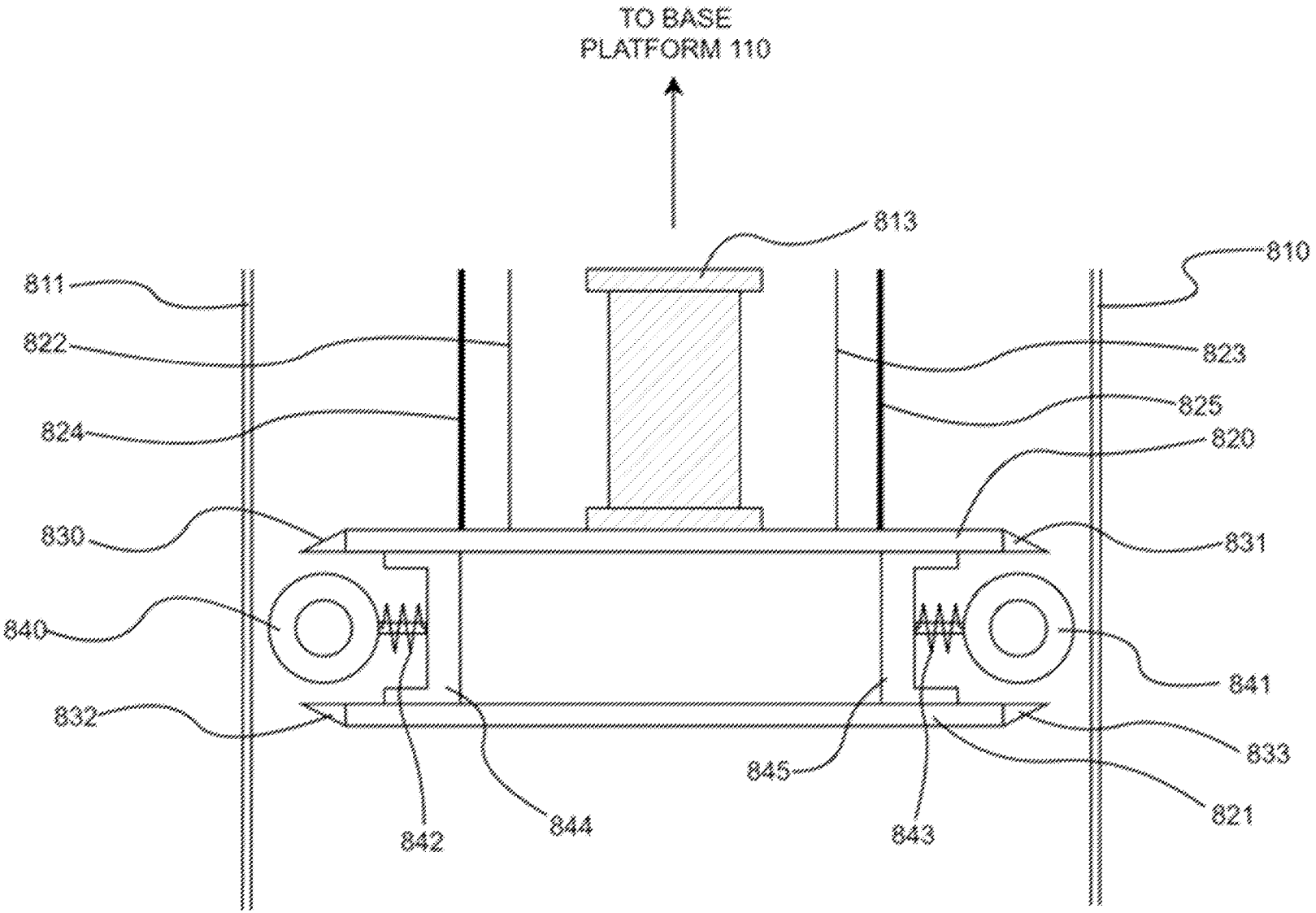
FIG. 8 shows an anti-jam system inside a bored pile shaft according to an embodiment of the subject invention.

Base platform 110, working platform 120, and end-effector 130 can each, respectively, be of varying construction in different embodiments. These constructions can include substantially flat structures as illustrated in FIG. 1A and FIG. 1B, as well as multiple layer structures (e.g., as shown in FIG. 7A and FIG. 7B for the base platform or as shown in FIG. 8 for the working platform), three dimensional constructs, or structures having arms or extensions (e.g., to support a pulley system including any of 115, 116, 117, 118, 121, 122, 123, 124, 125, 126, 321, 322, 323, 324, 421, 422, 423, 424, 521, 522, 523, 524, 635, 636) at a desired location. Construction of the base platform 110, working platform 120, and end-effector 130 can each, respectively, be configured to support implements such as a tremie pipe or air lift hose, to provide structural rigidity, or to interface with each other or with other systems.

Embodiments provide a first plurality of cable actuation units 111, 112 for controlling working platform 120, and second plurality of cable actuation units 113, 114 for controlling end-effector 130 that can locate at different positions on or out of the base platform 110 with different arrangements. The first and second plurality of actuation units 111, 112, 113, 114 can be located on the base platform 110 as illustrated in FIGS. 1A and 1B or at a fixed position not directly connected to but stationary relative to the base platform 110 as illustrated in FIG. 1C. In the illustration of FIG. 1D, some or all of the first plurality of cable actuation units 111, 112 can locate at different positions which can be on the base platform 110, or at a fixed position not directly connected to but stationary relative to the base platform 110. Some or all of the second plurality of cable actuation units 113, 114 can locate at different positions which can be on the base platform 110, or at a fixed position not directly connected to but stationary relative to the base platform 110. The cables 141, 142, 143, 144 can be routed from cable actuation units 111, 112, 113, 114 to working platform 120 and end-effector 130 through some or all of pulleys 115, 116, 117, 118, 121, 122, 123, 124, 125, 126 which can be mounted on base platform 110, working platform 120, or at a fixed position not connected to but stationary relative to the base platform 110.

Figure 2:
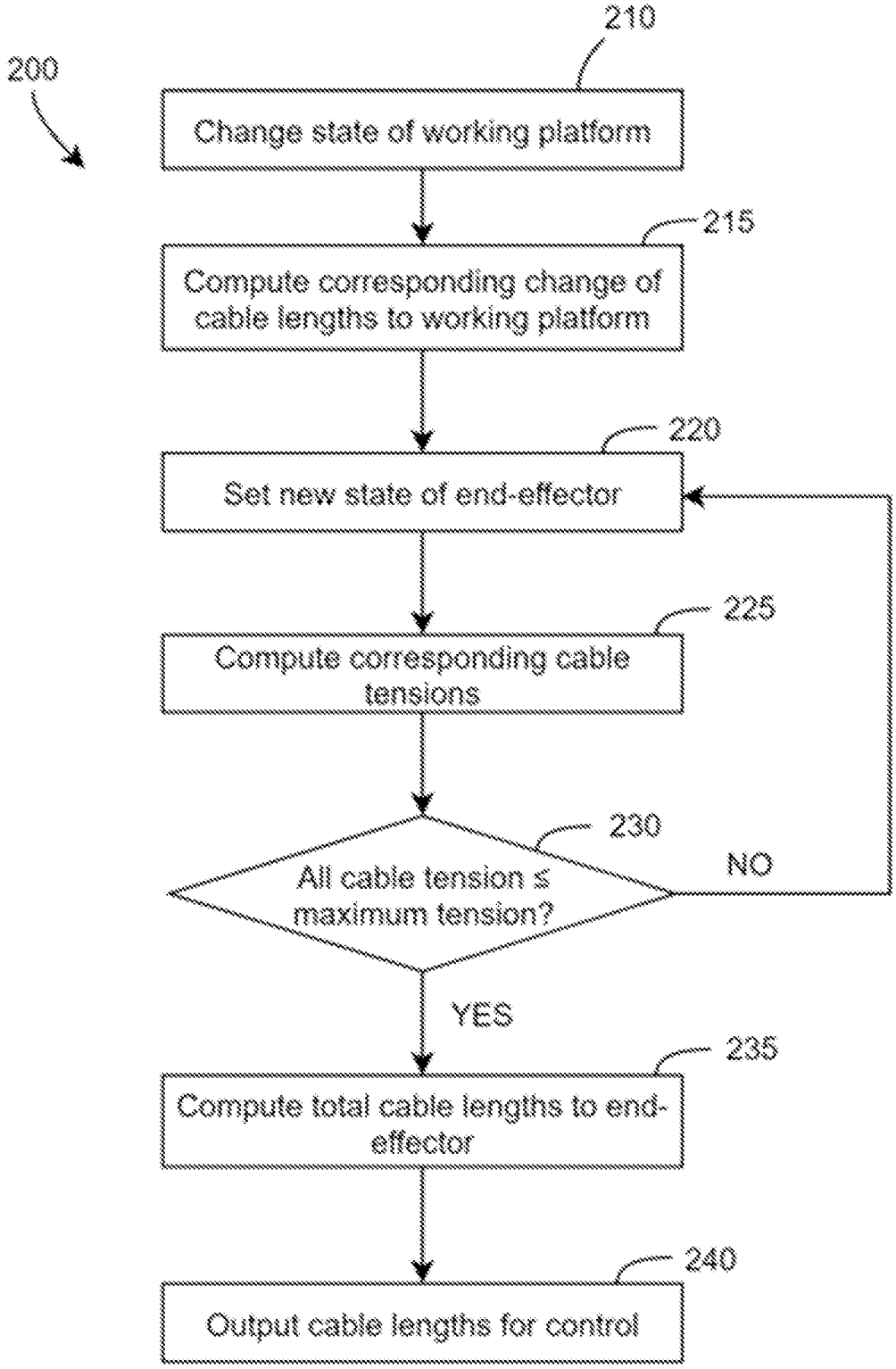
FIG. 2 is a flow diagram of a process of changing the states of the working platform and end-effector according to an embodiment of the subject invention.

FIG. 2 is a flow diagram of a process 200 for controlling an end-effector state (e.g., including position and orientation) based on the desired states of the working platform and the end-effector according to an embodiment of the subject invention. The desired states of the working platform 120 and the end-effector 130 can be calculated automatically based on different tasks or determined by user input. The process 200 is in certain embodiments referenced to the structure of FIGS. 1A and 1B. In general, process 200 is not limited to specific configurations of FIGS. 1A and 1B. Process 200 begins with a block 210 which indicates the target state of the working platform 120. In long shaft operations, the state of the working platform 120 usually stands for position in vertical direction and two tilting angles of the working platform 120. The block 210 is then followed by a block 215 to compute corresponding change of actuating cable lengths to the working platform 120. The current state of the working platform 120 is first obtained by the sensor system 150 and correlates with current actuating cable lengths which depend on the number of actuating cables. The change in actuating cable lengths is then calculated based on target state of the working platform 120 and current actuating cable lengths with the verifications of valid input state of the working platform 120 and availability of cable lengths of actuating units 111, 112.

The target state of the end-effector 130, including position and orientation, is then altered in block 220. The state of the end-effector 130 is highly related to the state of the working platform 120 in order to achieve accurate position and orientation in three dimensional space. The current state of the end-effector 130 is calculated based on the sensor system 151. The corresponding change in actuating cable lengths is then obtained. The block 220 is followed by a block 225 to compute the actuating cable tensions corresponding to the state of the end-effector and the actuating cable lengths. The calculations of actuating cable tensions vary dramatically for different designs and configurations of the end-effector 130. For example, using the flexible structure of the end-effector 530 as shown in FIG. 5, the actuating cable tensions are mainly determined by the elastic stiffness of the flexible structure of the end-effector 530 over the workspace of applications. The actuating cable tensions are also determined by other factors including, for example, method and location of pulleys 521, 522, 523, 524 for cable routing, as well as composition, size, and configuration of cables.

The validities of respective actuating cable tensions are analyzed in decision block 230. The maximum actuating cable tensions are limited by the working load limit of the pulleys 121, 122, 123, 124, 125, 126 and weight of the working platform 120. The actuating cable tensions have to be below maximum to inhibit unexpected tilting of the working platform 120 during the movement process of the end-effector 130. The unexpected tilting of the working platform 120 by the end-effector 130 actuating cables can be related to the weight and weight distribution of the working platform 120, and number and arrangement of the end-effector 130 actuating cables. If one or some of the calculated actuating cable tensions exceed maximum actuating cable tensions, the target state set in block 220 is not desired for the current state of the working platform 120 set in block 210. A new target state of the end-effector 130 has to be set again as shown in block 220. For some or all actuating cable tensions within maximum tension, the total cable lengths to end-effector 130 are calculated in block 235 with the consideration of target state of the working platform 120 in block 210 and the end-effector 130 in block 220. The resultant actuating cable lengths are then become the final output 240 for the process 200 for controlling the working platform 120 and the end-effector 130 to the desired state.

Figure 3:
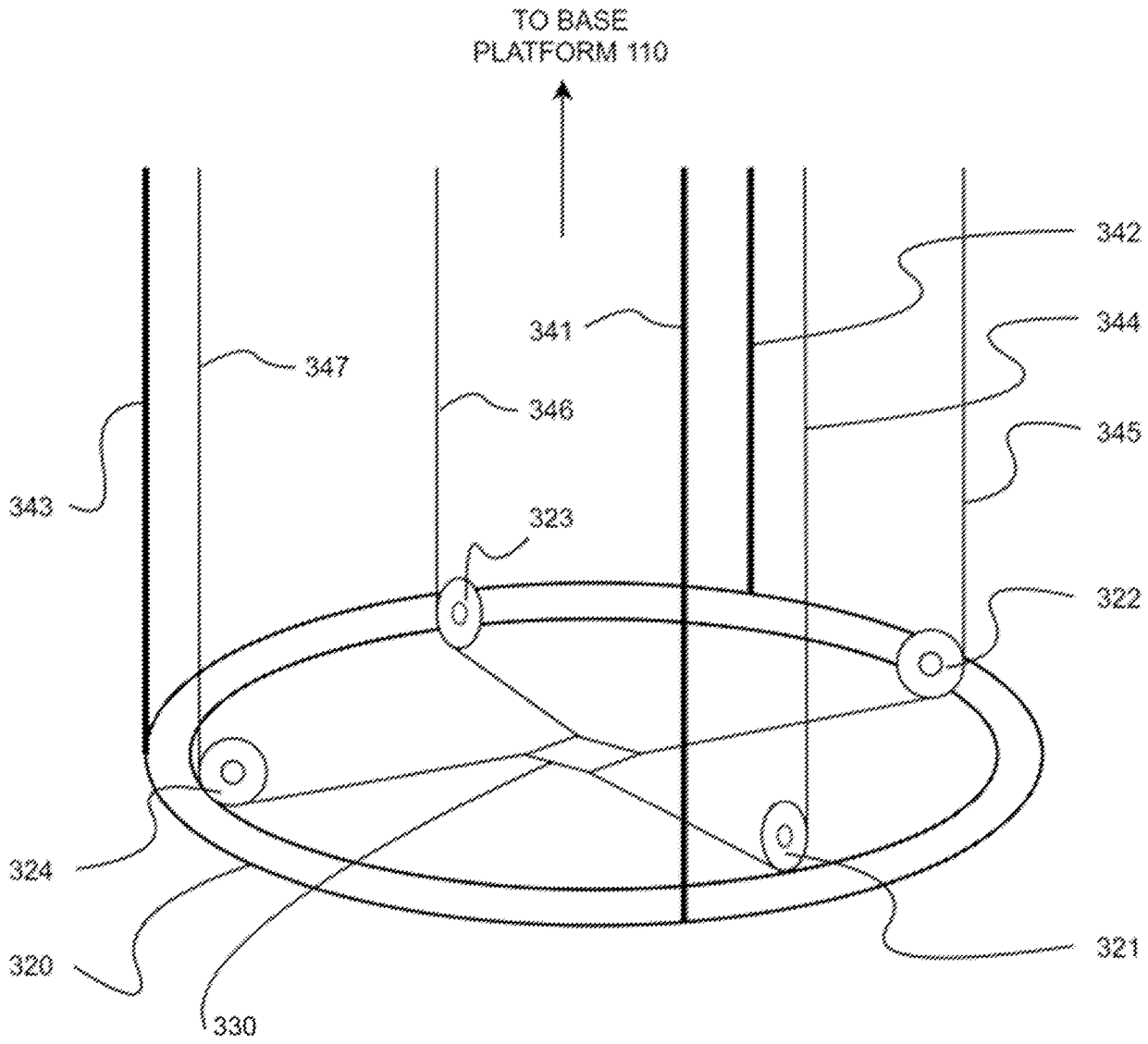
FIG. 3 shows a cable-driven parallel end-effector without rigid links to the working platform according to an embodiment of the subject invention.

FIG. 3 illustrates a cable-driven parallel end-effector 330 without rigid links to the working platform 320 according to an embodiment of the subject invention. The end-effector 330 is parallelly driven by cables 344, 345, 346, 347 routed through pulley system 321, 322, 323, 324 to perform planar motion with rotation with respect to the working platform 320. In FIG. 3, planar motion of the end-effector 330 is demonstrated. In general, the end-effector 330 can perform three dimension position translation with the control of three orientations relative to the working platform 320 with more cables connected to the end-effector 330. The working platform 320 is controlled by cables 341, 342, 343 to possess freedom in position in vertical direction and two tilting angles. The collaboration of motions from the working platform 320 and the end-effector 330 enables the end-effector 330 to perform three dimensional position translation and three dimensional orientation control throughout the operation space.

Figure 4:
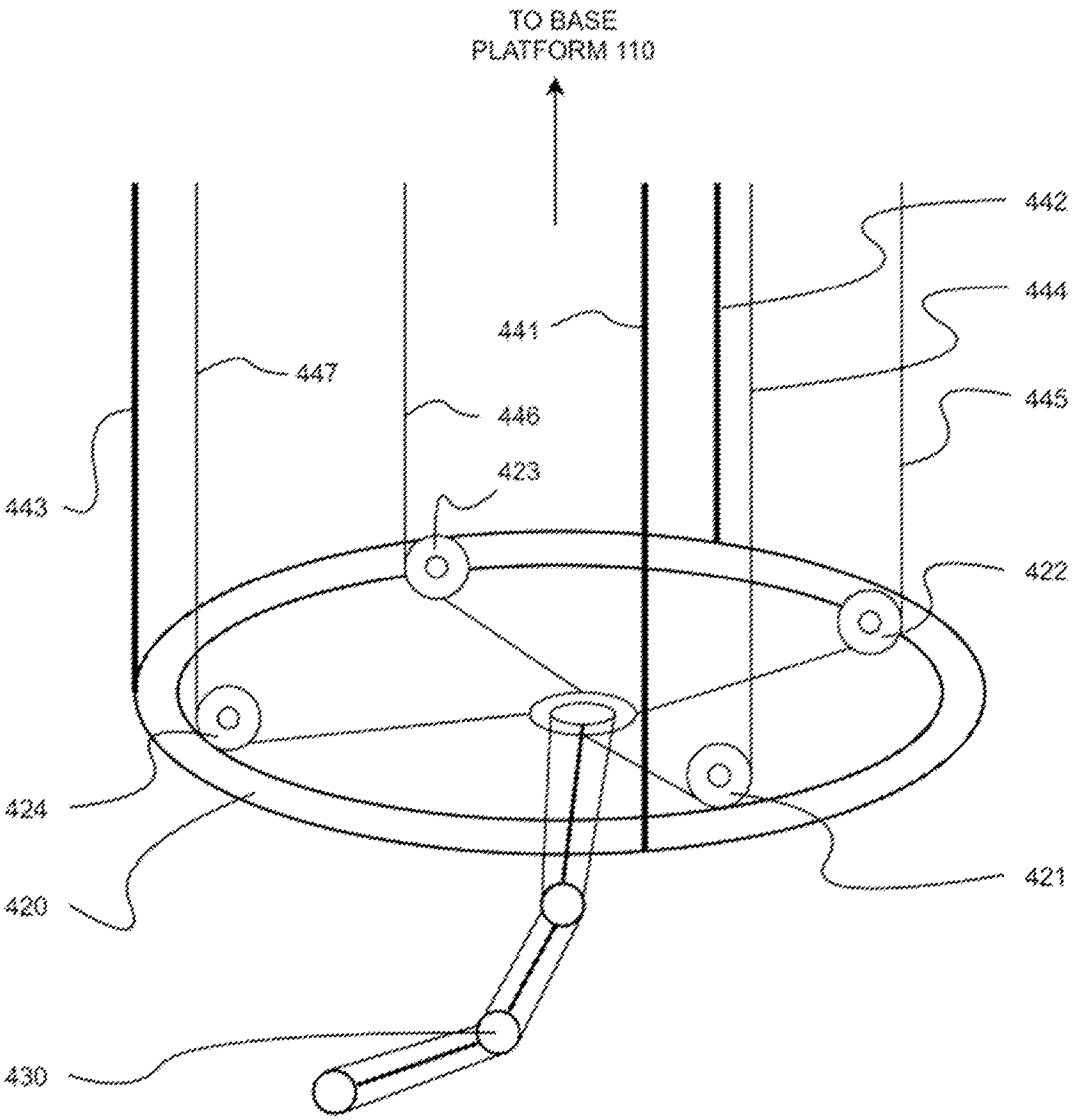
FIG. 4 shows a cable-driven end-effector with serial rigid links to the working platform according to an embodiment of the subject invention.

FIG. 4 illustrates a cable-driven end-effector 430 comprising a serially linked arm having three serial rigid links mounted to the working platform 420 according to an embodiment of the subject invention. The end-effector 430 is driven by cables 444, 445, 446, 447 routed through pulley system 421, 422, 423, 424 and internal cable routing in serial rigid link end-effector 430 to perform three dimensional motions of the tip of end-effector 430 with respect to the working platform 420. The working platform 420 is controlled by cables 441, 442, 443 to possess freedom in position in vertical direction and two tilting angles.

Figure 5A:
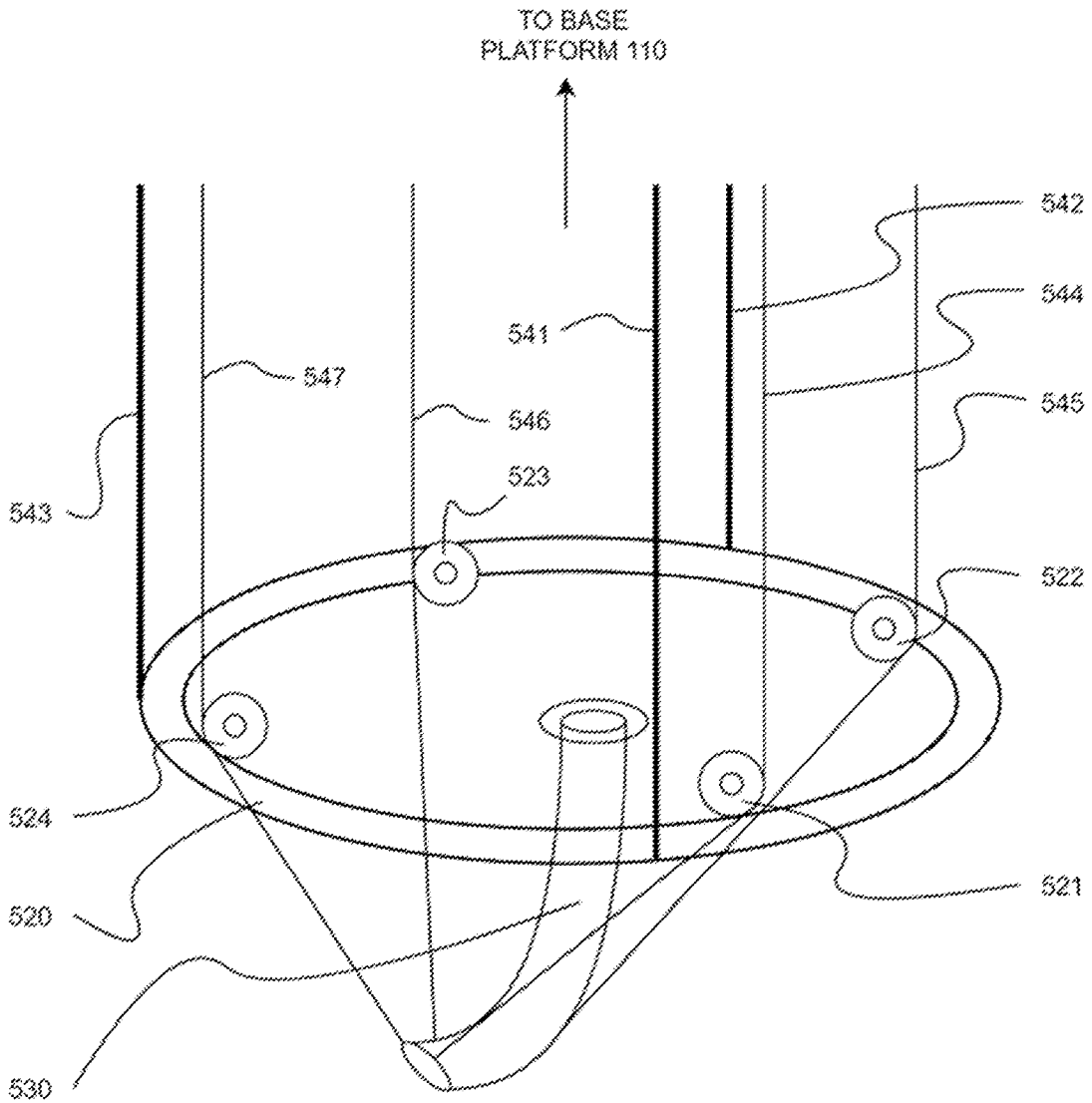
FIG. 5A and FIG. 5B each, respectively, show a cable-driven flexible end-effector according to an embodiment of the subject invention.
Figure 5B:
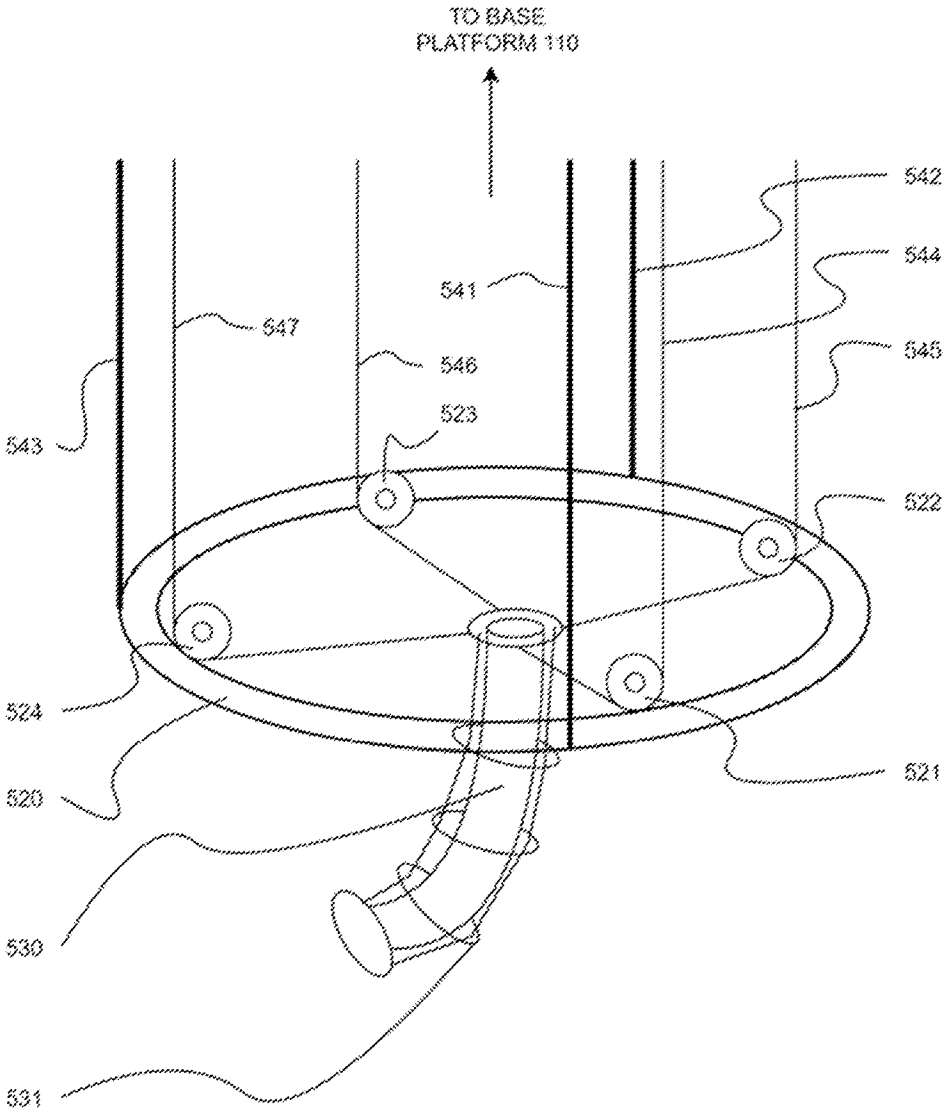

FIGS. 5A and 5B illustrate a cable-driven flexible end-effector 530 mounted to the working platform 520 according to an embodiment of the subject invention. The end-effector 530 is driven by cables 544, 545, 546, 547 routed through pulley system 521, 522, 523, 524. In FIG. 5A, the cables 544, 545, 546, 547 are directly connected to the tip of the flexible end-effector 530 from pulley system 521, 522, 523, 524. In FIG. 5B, the cables 544, 545, 546, 547 are connected to the tip of the flexible end-effector 530 with disks 531 along the body of the end-effector 530, then connected to the pulley system 521, 522, 523, 524. The end-effector 530 can perform three dimension motions under both configurations in FIGS. 5A and 5B. The working platform 520 is controlled by cables 541, 542, 543 to possess freedom in position in vertical direction and two tilting angles.

Figure 6:
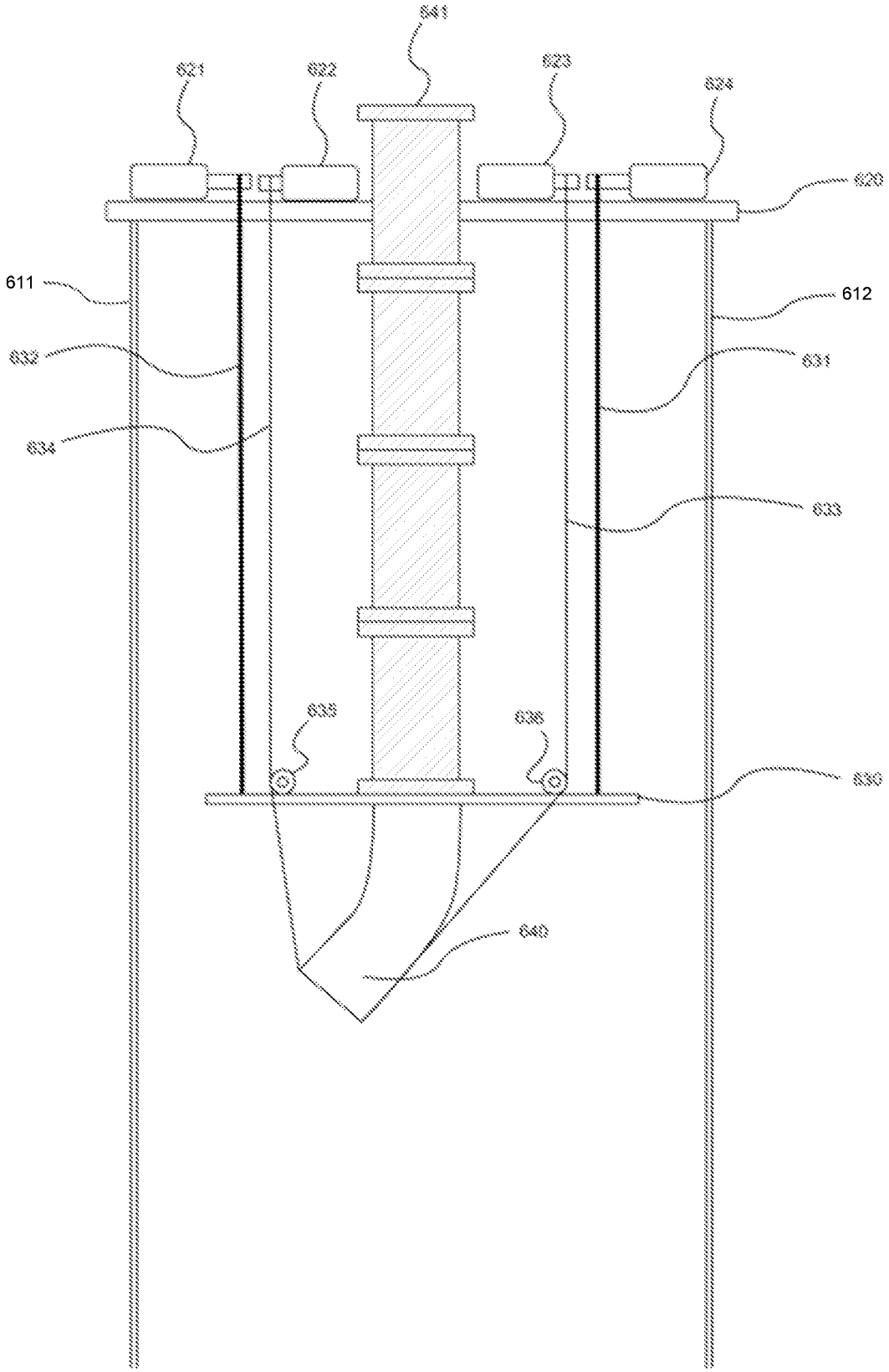
FIG. 6 shows a specific embodiment of a system with hard tremie pipe and flexible air-lift inlet hose as the end-effector according to an embodiment of the subject invention.

FIG. 6 illustrates one or more useful resources being delivered from the base platform 620 to the working platform 630 inside a long shaft (611 and 612) according to an embodiment of the subject invention. via a tube located inside the system according to an embodiment of the subject invention. FIG. 6 shows a specific embodiment of a system with hard tremie pipe and flexible air-lift inlet hose 640 as the end-effector according to an embodiment of the subject invention. The resource enters the system from a series of pipe 641 and exits at the end of a hose 640, that is capable of pointing at a multitude of directions. The entrance of the pipe can be located on top of the base platform 620 to facilitate continuous resource feeding. The hose can be located under the working platform and connected tightly with the pipe. The resource can exit at the tip of the hose 640, or at one or more locations along the hose. The direction of the end of the hose can be controllable by the actuation units 622, 623 on top of the base platform 620 via cables 633, 634 that is routed through pulley system 635, 636. The working platform 630 can be controlled by the actuation units 621, 624 via cables 631, 632 to possess freedom in position in vertical direction and two tilting angles.

FIG. 7A and FIG. 7B illustrate the stabilizing mechanism of the resource transmission pipe 730 inside a long shaft (711 and 712) according to an embodiment of the subject invention. The base platform can comprise, consist of, or be composed of two platform layers 710 and 720. Fixtures 713 and 714 can fix the upper platform layer 710 to lower platform layer 720. Drivers 721 and 722 can be the motors for manipulating the length of cables 723 and 724 for actuating the working platform 740 along the long shaft direction. Funnels 731, 732, 733 and 734 can be configured and used for helping the resource transmission pipe to align to the opening on bottom platform layer 720 when inserting the pipe from upper platform layer 710. When the working platform arrives at the target position, support structures 735 and 736 can unfold and press on the inner wall of the long shaft to hold the working platform 740 in place and keep the resource transmission pipe 730 stable when operating. In another configuration illustrated in FIG. 7B, the funnels can be replaced with rollable triangle trolley wheels 750 and 751, which can help to align the resource transmission pipe as same as the funnels but can also help to stabilize the pipe by pressing it to the center between the wheels. And the support structures 735 and 736 can be replaced with inflatable air bags 752 and 753. When the working platform arrives at the target position, the air bags 752 and 753 can inflate and act as supporting structures to hold the working platform in place while the inner walls of the long shaft can have bumps on them as the air bags can adapt to them.

FIG. 8 illustrates one embodiment of an anti-jam mechanism of the working platform operating in a bored pile comprising the bored pile's cross-section walls 810 and 811 according to an embodiment of the subject invention. The working platform can be composed of two platform layers 820 and 821. The working platform can carry resource delivery elements such as a pipe 813 as shown. The working platform can be suspended by wires 824, 825 and that are routed back to base platform 110's actuation motors for cable lengths manipulation. Wires 822 and 823 can be attached to the working platform and routed back to the draw wire sensors for detecting the state of the working platform. The chamfered anti-wear blocks 830, 831, 832 and 833 can be located at the edge of the two platform layers and can be used to slide the working platform aside when bumps or obstructions are encountered on the surface of 810 and 811. When the working platform slides towards either side of 810 and 811, a wheel (840 or 841) coupled with a spring and damper (842 or 843) mounted on the working platform by the mounting (844 or 845) can be configured to absorb the shock and stabilize the working platform while avoiding the edges of the platform jammed on the bumps by rolling through them by the wheel. If the working platform encounters bumps that are large enough that the platform cannot pass through, the draw wire sensors will not detect any change while the motors manipulate the length of wires as can be caused by slacked wires. In case of this, the system will be able to retract the respective wires that are slacked to avoid or inhibit the working platform sticking inside the bored pile.

Certain embodiments have been represented in two dimensional cross sectional views (e.g., FIGS. 1A-1D, 6, 7A-7B, and 8) showing, for example, symmetric or asymmetric left and right halves. Other embodiments have been represented in three dimensional perspective views (e.g., FIGS. 3, 4, 5A, and 5B) showing, for example, four symmetric quadrants. However, it is understood within the teachings of the subject invention that embodiments can provide any reasonable and practically advantageous number of features and elements distributed (e.g., radially, spherically, or rectilinearly) around the device or around a platform, taking advantage of symmetry or asymmetry to beneficially address specific needs of design, cost, operation, or manufacturing.

All patents, patent applications, provisional applications, and publications referred to or cited herein are incorporated by reference in their entirety, including all figures and tables, to the extent they are not inconsistent with the explicit teachings of this specification.

Following are examples that illustrate procedures for practicing the invention. These examples should not be construed as limiting. All percentages are by weight and all solvent mixture proportions are by volume unless otherwise noted.

Example 1—Comparison with Reverse Circulation Drill

Bored pile operations usually involve large machines. In particular, certain related art bored pile cleaning processes require a Reverse Circulation Drill (RCD). The following comparisons have been conducted between RCD and a robotic system according to an embodiment of the subject invention, from the view of quality and performance, price, and construction time.

Prior to a detailed competitive analysis, a brief understanding of the standard procedures of both RCD method and our method is entailed. The comparison between two operating procedures is summarized as follows in Table 1:

TABLE 1

| Index | RCD cleaning method | Proposed robotic cleaning method |
|---|---|---|
| 1 | Set up RCD machine | Set up the robotic system |
| 2 | Connect air-lifting pipe until working depth is reached | Drive the working platform to working depth with air-lifting pipe connected |
| 3 | Start air-lifting operations | Manipulate the air-lifting inlet to desired operating gesture, position, or pose |
| 4 | — | Start air-lifting operations |
| 5 | — | Monitor the quality of the air-lifting inlet operations |
| 6 | — | Manipulate the air-lifting inlet to another desired operating gesture, position, or pose |
| 7 | — | Repeat steps 4 to 6 until the air-lifting is done |

With regard to quality and performance, conventional RCD cleaning process does not guarantee the performance of cleaning. There is no control at cleaning inlet at deep underground where the cleaning is assumed to be successful with sufficient cleaning time underground. If the cleaning inlet leans to one side of the bored pile, incomplete cleaning might occur at the other side. Under this situation, the users can have no solution to manipulate the cleaning inlet to other side to assure the cleaning quality. Also, there can be no direct monitoring of the quality of cleaning. The cleaning quality is confirmed when drilling rock samples are obtained after concrete is filled to the bored pile.

In contrast, embodiments of the provided robotic system possesses the ability to control the cleaning inlet at deep underground locations. In certain embodiments, the cleaning inlet is regarded as the end-effector and there is one set of cables responsible to manipulate the end-effector state and gesture. The cleaning inlet can conduct three-dimensional motions underground to ensure the cleaning inlet is pointed the target position and direction in the bored pile. Certain embodiments can provide a sensor system with draw wire sensors and gyroscope sensors to ensure accurate motions are conducted and enable automation of cleaning motions of the cleaning inlet. Thus, each point of bored pile can be managed to have standard cleaning time and the cleaning time at each point can be recorded to generate reports for justification and further improvement.

With regard to price, RCD is not specifically designed for cleaning process. Instead, the major usage of RCD is to drill a deep pile to remove soil and rock. Cleaning process is conducted after drilling is conducted with bored pile installed. Therefore, the design of RCD is complicated where the major functions of the RCD are not fully utilized during cleaning process. The cost of RCD is usually expensive with rental price HKD$9,500 (US$1,215) per day.

Compared to RCD, embodiments of the provided robotic system can have much simpler design. Embodiments can be designed and optimized to target specific applications, such as the cleaning process. Since the loading during cleaning processes is relatively small compared to drilling processes, structural designs and actuation units of certain embodiments can be in a smaller scale compared to RCD. The costs, including building cost, transportation cost and operational cost, of embodiments of the robotic system would be lower than that of RCD.

With regard to construction time, setup time is important in construction since setup requires labors and labor salary can be relatively high. Currently, the entire RCD cleaning process is expected to take 1 to 2 days, while much of the time is spent on assembling and dissembling RCD, pipes and other machinery. It is expected that embodiments can significantly improve efficiency of the cleaning procedure, while reducing cost and shortening construction time for bored pile foundations.

Besides setup time, the vacancy of RCD also becomes a bottleneck of shortening construction time. Due to expensive cost of RCD, construction companies usually rent RCD when there is need. The number of rented RCD is also limited but there are many bored piles in a construction. Therefore, situation of idle bored piles often occurs during construction. Within lower cost, embodiments can be built with adequate numbers to fully utilize bored piles. Thus, the construction time could be shortened with embodiments of the subject invention.

With regard to market potential, bored pile operations usually involve large machines. In particular, the current bored pile cleaning process requires an RCD. The following analysis will be conducted focusing on the commercial relevance of the provided robotic cleaning systems, methods, and process.

The construction of the foundation is not only critical to the building's structural stability, but also a time consuming and costly operation. A single foundation can take 25 days to construct and costs from HKD$1.8 million (US$230,000 for a 30 m deep foundation) to HKD$6 million (US$767,000 for a 100 m deep foundation), where the typical foundation depth is 50 m (costing HKD$3 million or US$384,000). Furthermore, number of foundations of typical construction projects can range from approximately 20 (e.g., residential flat) to approximately 500 (e.g., New Acute Hospital at Kai Tak Development Area) bored pile foundations.

The quality of cleaning process highly influences the interface between concrete foundations and the rock layer. If poor interface is found in a single bored pile, the bored pile foundation could be abandoned. Multiple extra bored pile foundations are required to build to replace the single poor bored pile foundation in considering of loading distribution, leading to the loss of several hundred thousand to millions of dollars depending on the size of foundations. As introduced in previous comparison, the performance of RCD process is not guaranteed. Our robotic system has the capability to conduct the cleaning process in a more precise and controlled way, reducing the chance of poor interface of concrete foundations. Thus, there is a need for reliable cleaning method of bored pile operations in the market.

According to quarterly construction report from Census and Statistics Department of Hong Kong, the gross value of piling and related foundation works are as follows:

| Quarter | Value (HK$ million) |
|---|---|
| 2020 Q1 | 3,023 |
| 2020 Q2 | 2,538 |
| 2020 Q3 | 3,290 |
| 2020 Q4 | 4,464 |
| 2021 Q1 | 3,860 |
| 2021 Q2 | 3,138 |
| 2021 Q3 | 2,891 |

From above table, the gross values of piling and related foundation works range from HK$2.5 billion to HK$4.5 billion per quarter. Embodiments of the subject invention can provide automation of cleaning processes of bored pile foundations. Embodiments can further enable additional functions, such as detection of cracks of and weldment of inner walls of bored pile. The market potential and sustainability of the subject invention is high as embodiments are capable to be more involved in the piling and related foundation works.

It should be understood that the examples and embodiments described herein are for illustrative purposes only and that various modifications or changes in light thereof will be suggested to persons skilled in the art and are to be included within the spirit and purview of this application and the scope of the appended claims. In addition, any elements or limitations of any invention or embodiment thereof disclosed herein can be combined with any and/or all other elements or limitations (individually or in any combination) or any other invention or embodiment thereof disclosed herein, and all such combinations are contemplated with the scope of the invention without limitation thereto.

We claim:

1. A system for operating in long piles or shafts, the system comprising:

a fixed base platform, a movable working platform driven by a first plurality of cables, and a cable-driven end-effector coupled with the working platform and driven by a second plurality of cables;

wherein the cable-driven end-effector is configured to perform planar motions with rotations with respect to the working platform when the second plurality of cables are operated in synchronization, and wherein the cable-driven end-effector is configured to deviate from a vertical axis while the movable working platform remains vertically aligned.

2. The system of claim 1, wherein each cable of the first plurality of cables is attached to a corresponding cable actuating unit of a first plurality of cable actuating units, and wherein each cable actuating unit of the first plurality of cable actuating units is configured to control the length of a correspondingly attached cable of the first plurality of cables.

3. The system of claim 1, wherein a first plurality of cable actuating units is configured to control a position and orientation of the working platform through the first plurality of cables; and wherein a second and independent plurality of cable actuating units is configured to control a position and orientation of the end-effector through the second plurality of cables.

4. The system of claim 3, wherein the first plurality of cable actuating units and the second plurality of cable actuating units are located at the base platform.

5. The system of claim 1, wherein the working platform comprises a first sensor system configured to determine a position and orientation of the working platform.

6. The system of claim 5, wherein the first sensor system comprises one or more draw wire sensors, one or more gyroscopes, one or more sonar sensors, or one or more lidar sensors.

7. The system of claim 1, wherein the end-effector comprises a second sensor system configured to determine a position and orientation of the end-effector.

8. The system of claim 7, wherein the second sensor system comprises one or more draw wire sensors, one or more gyroscopes, one or more sonar sensors, or one or more lidar sensors.

9. The system of claim 1, wherein the base platform is configured for location at one of a plurality of different positions prior to operation of the system; wherein the first plurality of cables are connected to the working platform, optionally through a first pulley system; and wherein the second plurality of cables are connected to the end-effector through a second pulley system.

10. The system of claim 1, wherein the end-effector is coupled with the working platform without rigid links, and wherein the end-effector is coupled with the working platform at least in part by the second plurality of cables.

11. The system of claim 1, wherein the end-effector comprises a serially linked arm, and wherein the serially linked arm comprises a plurality of interconnected links configured to be driven by the second plurality of cables and is mounted on the working platform.

12. The system of claim 1, wherein the system is configured to operate inside a bored pile shaft.

13. The system of claim 1, wherein the end-effector comprises a flexible hose entirely made of a flexible material, allowing continuous bending along its entire length, and wherein the flexible hose is configured for resource transportation or delivery.

14. The system of claim 13, wherein the flexible hose is a flexible air-lift inlet hose.

15. The system of claim 14, wherein the system comprises a tremie pipe stabilizing system.

16. The system of claim 15, wherein the tremie pipe stabilizing system is configured to stabilize an end of a tremie pipe at or near the working platform and to stabilize an opposite end of the tremie pipe at or near the base platform when inserting a new section of the tremie pipe.

17. A method for controlling an end-effector to reach a specified position and orientation in a three-dimensional space within a long pile or shaft, the method comprising:

providing a system comprising:

a fixed base platform, a movable working platform controlled by a first plurality of cables, a cable-driven end-effector supported by the working platform, the end-effector controlled by a second plurality of cables, wherein the cable-driven end-effector is configured to perform planar motions with rotations with respect to the working platform when the second plurality of cables are operated in synchronization, and the cable-driven end-effector is configured to deviate from a vertical axis while the movable working platform remains vertically aligned; and a control system comprising an end-effector sensor system configured to determine an actual position and orientation of the end-effector;

receiving feedback from the control system; and controlling the position and orientation of the end-effector by adjusting a working condition of the first plurality of cables and a working condition of the second plurality of cables based on the feedback to reach the specified position and orientation in the three-dimensional space within the long pile or shaft.

18. The method of claim 17, wherein:

the first plurality of cables originates from the base platform;

the second plurality of cables originates from the base platform;

the control system further comprises a working-platform sensor system configured to determine an actual working condition, position, and orientation of the working platform; and the end-effector sensor system is further configured to determine an actual working condition of the end-effector;

such that the feedback comprises the actual working condition, position, and orientation of the working platform and the actual working condition, position, and orientation of the end-effector.

19. A system for operating in long piles or shafts, the system comprising:

a fixed base platform, a movable working platform driven by a first plurality of cables, a cable-driven end-effector coupled with the working platform and driven by a second plurality of cables;

wherein a first plurality of cable actuating units is configured to control a position and orientation of the working platform through the first plurality of cables, and wherein a second and independent plurality of cable actuating units is configured to control a position and orientation of the end-effector through the second plurality of cables;

wherein the first plurality of cable actuating units and the second plurality of cable actuating units are located at the base platform;

wherein the working platform comprises a first sensor system configured to determine the position and orientation of the working platform;

wherein the first sensor system comprises one or more draw wire sensors, one or more gyroscopes, one or more sonar sensors, and at least one lidar sensor;

wherein the end-effector comprises a second sensor system configured to determine the position and orientation of the end-effector;

wherein the second sensor system comprises one or more draw wire sensors, one or more gyroscopes, one or more sonar sensors, and at least one lidar sensor;

wherein the base platform is configured for location at one of a plurality of different positions prior to operation of the system; wherein the first plurality of cables are connected to the working platform, optionally through a first pulley system; and wherein the second plurality of cables are connected to the end-effector through a second pulley system;

wherein the end-effector is coupled with the working platform without rigid links, and the end-effector is coupled with the working platform at least in part by the second plurality of cables;

wherein the system is configured to operate inside a bored pile shaft;

wherein the system comprises rigid pipe, and wherein the end-effector comprises a flexible hose configured for resource transportation or delivery;

wherein the rigid pipe is tremie pipe, wherein the flexible hose is a flexible air-lift inlet hose;

wherein the system comprises a tremie pipe stabilizing system;

wherein the tremie pipe stabilizing system is configured to stabilize an end of the tremie pipe at or near the working platform and to stabilize an opposite end of the tremie pipe at or near the base platform when inserting a new section of tremie pipe;

wherein the system comprises an anti-jam system attached to the working platform, and wherein the anti-jam system comprises a plurality of guide rollers and a plurality of platform plates, each platform plate, respectively, having one or more chamfered sides.

20. A system for operating in long piles or shafts, the system comprising:

a fixed base platform, a movable working platform driven by a first plurality of cables, and a cable-driven end-effector coupled with the working platform and driven by a second plurality of cables;

wherein the system is configured to operate inside a bored pile shaft, and wherein the system comprises an anti-jam system attached to the working platform, wherein the anti-jam system comprises a plurality of guide rollers and a plurality of platform plates, each platform plate, respectively, having one or more chamfered sides.

* * * * *